US011799242B2

(12) United States Patent
Yin et al.

(10) Patent No.: US 11,799,242 B2
(45) Date of Patent: Oct. 24, 2023

(54) UNIPOLAR CONNECTION TERMINAL FOR HIGH-VOLTAGE CONNECTOR, AND CONNECTOR DEVICE

(71) Applicant: TYCO ELECTRONICS (SHANGHAI) CO., LTD., Shanghai (CN)

(72) Inventors: Jianrui Yin, Shanghai (CN); Weidong Zhang, Shanghai (CN)

(73) Assignee: TYCO ELECTRONICS (SHANGHAI) CO., LTD., Shanghai (CN)

( * ) Notice: Subject to any disclaimer, the term of this patent is extended or adjusted under 35 U.S.C. 154(b) by 57 days.

(21) Appl. No.: 17/511,781

(22) Filed: Oct. 27, 2021

(65) Prior Publication Data

US 2022/0140533 A1 May 5, 2022

(30) Foreign Application Priority Data

Oct. 30, 2020 (CN) ..... 202022480152.X

(51) Int. Cl.
*H01R 13/64* (2006.01)
*H01R 13/642* (2006.01)
*H01R 13/187* (2006.01)

(52) U.S. Cl.
CPC ..... *H01R 13/642* (2013.01); *H01R 13/187* (2013.01)

(58) Field of Classification Search
None
See application file for complete search history.

(56) References Cited

U.S. PATENT DOCUMENTS 9,985,376 B2 * 5/2018 Zhang ..... H01R 13/113
2015/0014965 A1 1/2015 Gibson

FOREIGN PATENT DOCUMENTS

DE 20220259 U1 4/2003
DE 102004002402 11/2005
WO 2014111135 A1 7/2014

OTHER PUBLICATIONS

Search Report for UK Application No. GB2115563.5, dated Jun. 27, 2022.

* cited by examiner

*Primary Examiner* — Ross N Gushi
(74) *Attorney, Agent, or Firm* — Potomac Law Group, PLLC

(57) ABSTRACT

A unipolar connection terminal for a high-voltage connector and a connector device are provided in the invention. The unipolar connection terminal is mounted in a housing of the connector device. The connector device has a columnar insertion tube to be connected and passed through by a mating terminal, an end portion of the insertion tube extends in a radial direction to form at least three protrusion structures, and the at least three protrusion structures are arranged at intervals in a circumferential direction of an end surface of the insertion tube. According to the unipolar connection terminal and the connector device provided by the invention, when the unipolar connection terminal is mounted in the housing of the connector device, an erroneous assembly can be effectively avoided due to the arrangement of the protruding structures disposed at the end portion of the insertion tube, and a conduction effect of the connector device is guaranteed.

11 Claims, 1 Drawing Sheet

UNIPOLAR CONNECTION TERMINAL FOR HIGH-VOLTAGE CONNECTOR, AND CONNECTOR DEVICE

TECHNICAL FIELD

The invention relates to the technical field of connectors, and particularly relates to a unipolar connection device for high-voltage connector, and a connector device.

BACKGROUND OF INVENTION

A connector is used for establishing an electrical connection between a first conductive wire and a second conductive wire, what's more, the connector is also used for establishing an electrical connection between the first conductive wire and an electric appliance, the connector is provided with a connection terminal used for mounting copper wire, and the connection terminal is arranged in the connector. A columnar terminal in the related art usually has a non-polar or bipolar design, however, a high-voltage columnar terminal adapted to be arranged in the connector is usually a unipolar terminal, and does not have a fool-proof design, a risk of erroneous assembly is extremely prone to occur, and a conduction effect of the connector is affected.

SUMMARY OF INVENTION

An objective of the invention is to provide an unipolar connection terminal for a high-voltage connector, and a connector device, which aim at solving a technical problem in the prior art that an unipolar connection terminal is prone to being mistakenly mounted, thereby affecting a conduction effect of the connector device.

In order to achieve the above-mentioned objective, the technical solutions adopted in the invention are as follow:

A unipolar connection terminal for a high-voltage connector is provided, the unipolar connection terminal includes a columnar insertion tube configured to be connected and passed through by a mating terminal, an end portion of the insertion tube extends in a radial direction to form at least three protrusion structures, and the at least three protrusion structures are arranged at intervals in a circumferential direction of an end surface of the insertion tube.

In one embodiment, at least one of the protrusion structures is a first fool-proof protrusion, and the remaining protrusion structures are second fool-proof protrusions, and a cross-sectional area of the first fool-proof protrusion is greater than a cross-sectional area of any one of the second fool-proof protrusions.

In one embodiment, another end of the insertion tube being axially away from the protruding structures is provided with a crimping part configured to press the mating terminal tightly; one of the first fool-proof protrusion and the second fool-proof protrusions, and the crimping part are located on the same side circumferentially.

In one embodiment, the second fool-proof protrusion and the crimping portion are located on the same side circumferentially.

In one embodiment, a circumferential arc length between the first fool-proof protrusion and the second fool-proof protrusions is greater than a circumferential arc length between the second fool-proof protrusions.

In one embodiment, the plurality of protrusion structures comprise two second fool-proof protrusions; and distances between the first fool-proof protrusion and the two second fool-proof protrusions are identical.

In one embodiment, the plurality of protrusion structures comprise two second fool-proof protrusions; a circumferential arc length between the two second fool-proof protrusions is greater than a width of the first fool-proof protrusion.

In one embodiment, the unipolar connection terminal is a one-piece member integrally molded by punching.

In one embodiment, the unipolar connection terminal further includes an elastic structure, the elastic structure is configured to be arranged in the insertion tube, and the elastic structure comprises a plurality of elastic pieces configured to be in an electrical contact with the mating terminal.

In one embodiment, the elastic piece structure comprises a pair of annular end portions, two ends of each of the plurality of elastic pieces are fixedly connected with the annular end portions respectively; each of the annular end portions is provided with an inner convex abutting protrusion.

A connector device is further provided in the invention, the connector device includes a housing having an inner cavity, and the unipolar connection terminal arranged in the housing, an inner wall of the housing is recessed to form relief grooves configured to accommodate the protrusion structures.

In one embodiment, the protruding structures comprise a first fool-proof protrusion and second fool-proof protrusions, an inner wall of the housing is recessed to form a first rectangular relief groove configured for accommodating the first fool-proof protrusion and second rectangular relief grooves configured for accommodating the second fool-proof protrusions, a circumferential arc length between two adjacent second fool-proof protrusions is greater than a width of the first relief groove.

In one embodiment, an outer peripheral wall of the insertion tube is provided with snap-fit protrusions, an inner wall of the housing is provided with snap-fit members configured to match with the snap-fit protrusions.

In one embodiment, there are a plurality of the snap-fit protrusions, and the plurality of the snap-fit protrusions are arranged at intervals on the outer peripheral wall of the insertion tube.

In one embodiment, the snap-fit protrusions are snap-fit elastic pieces.

The advantageous effects of the unipolar connection terminal for high-voltage connector provided by the invention are as follows: compared with the related art, according to the unipolar connection terminal of the invention, the end portion of the columnar insertion tube to be connected and passed through by the mating terminal extends in the radial direction to form at least three protrusion structures, and the at least three protrusion structures are arranged at intervals in the circumferential direction of the end surface of the insertion tube, so that an erroneous assembly can be effectively avoided due to the arrangement of the protrusion structures disposed at the end portion of the insertion tube when the unipolar connection terminal is mounted in the housing of the connector device, and the conduction effect of the connector device can be guaranteed.

The advantageous effects of the connector device provided by the invention are as follows: compared with the related art, according to the connector device of the invention, the aforesaid unipolar connection terminal is arranged in the housing with the inner cavity, the inner wall of the housing is recessed to form relief grooves for accommodating the protruding structures, the unipolar terminal has at least three protrusion structures which are formed by extending in the radial direction of the end portion of the columnar insertion tube to be connected and passed through by the mating terminal, the at least three protrusion structures are arranged at intervals in the circumferential direction of the end surface of the insertion tube, so that an erroneous assembly can be effectively avoided according to the matching between the protruding structures arranged at the end portion of the insertion tube and the relief grooves formed on the inner wall of the housing when the unipolar connection terminal is mounted in the housing of the connector device, and the conduction effect of the connector device is guaranteed.

BRIEF DESCRIPTION OF THE DRAWINGS

To describe the embodiments of the invention more clearly, a brief introduction regarding the accompanying drawings that need to be used for describing the embodiments of the invention or the prior art is given below; it is apparent that the accompanying drawings described herein are merely some embodiments of the invention, the person of ordinary skill in the art can also acquire other drawings according to these drawings without paying creative labor.

REFERENCE NUMERALS IN THE FIGURES ARE LISTED AS FOLLOW

1-unipolar connection terminal; 2-insertion tube; 21-snap-fit protrusion; 3-convex structure; 31-first fool-proof protrusion; 32-second fool-proof protrusion; 4-crimping part; 5-elastic structure; 51-elastic piece; 52-annular end portion; 521-abutting protrusion.

DESCRIPTION OF THE EMBODIMENTS

To make the purpose, the technical solution and the advantages of the invention be clearer and more understandable, the invention will be further described in detail below with reference to accompanying figures and the embodiments. It will be appreciated that the specific embodiments described herein are merely intended to illustrate but not to limit the invention.

It needs to be noted that, when one component is described to be "fixed to" or "arranged on" another component, this component can be directly or indirectly arranged on another component. When it is described that one component "is connected with" another component, this component can be directly or indirectly connected to another component.

It will be appreciated that, the orientational or positional relationships indicated by terms such as "length", "width", "upper", "lower", "front", "rear", "left", "right", "vertical", "horizontal", "top", "bottom", "internal", "external" and the like are based on the orientational or positional relationships shown in the accompanying figures and are only used for describing the invention and are for the convenience of describing rather than indicating or implying that the indicated device or element must have a specific orientation and is constructed and operated in a specific orientation, thus, these orientational or positional relationships should not be interpreted as limitations to the present disclosure.

Additionally, the terms of "the first" and "the second" are only for the convenience of describing and should not be interpreted as indicating or implying relative importance or implicitly indicating the number of indicated technical features. A feature which is limited by "the first" or "the second" may explicitly or implicitly indicates that one or more of the features are included. "Multiple/a plurality of" means two or more than two, unless there is an additional explicit and specific stipulation.

Figure 1:
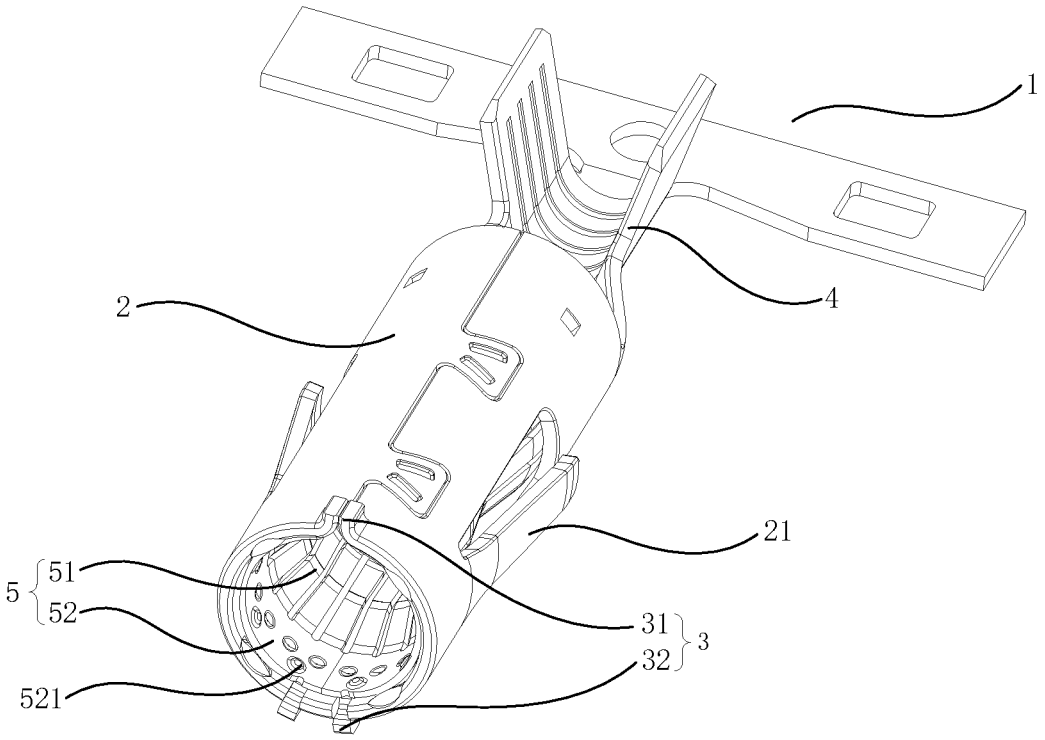
FIG. 1 is a schematic diagram of a stereoscopic structure of an unipolar connection terminal according to one embodiment of the invention.
Figure 2:
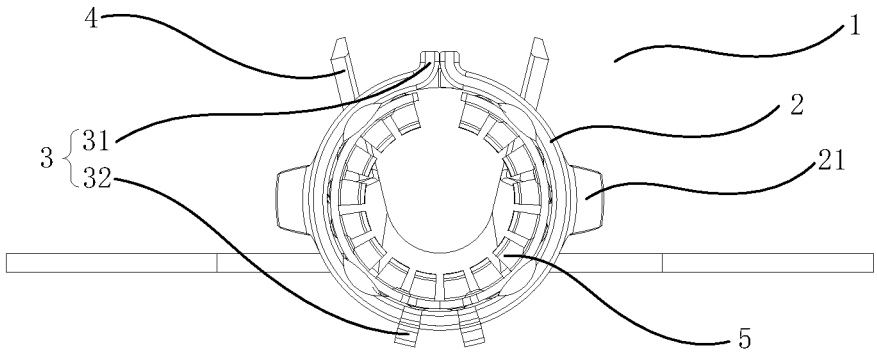
FIG. 2 is a schematic diagram of a structure of the unipolar connection terminal seen from the front according to one embodiment of the invention.

Referring to FIG. 1 and FIG. 2, an unipolar connection terminal 1 for a high-voltage connector is provided in this embodiment, the unipolar connection terminal 1 is mounted in a housing of a connector device, the specific structure and the number of the unipolar connection terminal 1 are not limited herein; optionally, the unipolar connection terminal 1 is an one-piece member integrally molded by punching, so that the production efficiency is high, a mass production is facilitated, and a production cost is reduced. The unipolar connection terminal 1 includes a columnar insertion tube 2 configured to be connected and passed through by a mating terminal, at least three protrusion structures 3 is formed by extending in a radial direction of an end portion of the insertion tube 2, and the at least three protrusion structures 3 are arranged at intervals in a circumferential direction of an end surface of the insertion tube 2; optionally, distances between two adjacent protrusion structures 3 are not identical. According to the aforesaid unipolar connection terminal 1, when the unipolar connection terminal 1 is mounted in the housing of the connector device, an erroneous assembly can be effectively avoided due to the arrangement of the protrusion structure 3 disposed at the end portion of the insertion tube 2, and the conduction effect of the connector device is guaranteed.

Referring to FIG. 1 and FIG. 2, as a specific implementation of the unipolar connection terminal 1 for high-voltage connector provided in this embodiment, at least one protrusion structure 3 of the unipolar connection terminal 1 is a first fool-proof protrusion 31, the remaining protrusion structures 3 are second fool-proof protrusions 32, and a cross-sectional area of the first fool-proof protrusion 31 is greater than a cross-sectional area of any one of the second fool-proof protrusions 32. Since the protrusion structures 3 are classified into the first fool-proof protrusion 31 with larger cross-sectional area and the second fool-proof protrusions 32 with smaller cross-sectional area, an assembler is facilitated to better distinguish the protrusion structures during assembly, an avoidance of erroneous assembly is facilitated, and the conduction effect of the connector device is guaranteed.

Further referring to FIG. 1, in this embodiment, another axial end of the insertion tube 2 of the unipolar connection terminal 1 being away from the protrusion structure 3 is provided with a crimping part 4 configured to press the mating terminal tightly, in this way, in one aspect, can increase the contact area between the mating terminal and the unipolar connection terminal 1 can be increased, and guaranteeing of the conduction effect is facilitated, in another aspect, the crimping part can be used to limit the movement of the mating terminal with respect to the unipolar connection terminal 1, such that the mating terminal can be secured with the unipolar connection terminal 1 more firmly, thereby facilitates improving the reliability of the unipolar connection terminal 1; optionally, one of the first fool-proof protrusion 31 and the second fool-proof protrusion 32, and the crimping part 4 are located at the same side in the circumferential direction, which facilitates the assembler to better distinguish during assembly, the erroneous assembly can be better avoided, and the conduction effect of the connector device is ensured; preferably, the second fool-proof protrusion 32 and the crimping part 4 are located at the same side in the circumferential direction, since the number of the second fool-proof protrusions 32 disposed on the insertion tube 2 is greater than the number of the first fool-proof protrusions 31 disposed on the insertion tube 2, the second fool-proof protrusions 32 and the crimping part 4 are arranged on the same side of the insertion tube 2, so that the assembler is facilitated to better distinguish and make a more accurate alignment during assembly, and the erroneous assembly can be better avoided, and the conduction effect of the connector device is ensured.

Optionally, the crimping part 4 has an inner side surface that abuts against the mating terminal, and the inner side surface is an arc-shaped crimping surface, such that the inner side surface of the crimping part 4 can attach with the surface of the mating terminal better, a contact surface between the mating terminal and the crimping part 4 is increased, which is beneficial for ensuring the quality of signal transmission. Optionally, the inner side surface of the crimping part 4 is provided with an anti-slip part which is configured to increase a bonding force between the crimping part 4 and the mating terminal to realize a more stable connection between the crimping part 4 and the mating terminal; Optionally, the anti-slip part is a plurality of crimping grooves recessed on the inner side surface, such that a cold welding effect is generated between the crimping part 4 and the mating terminal while a contact area as large as possible between the mating terminal and the crimping part 4 is ensured, a more stable connection between the crimping part 4 and the mating terminal is realized, electrical performance is better, and the conduction effect of the unipolar connection terminal 1 is better ensured.

Referring to FIG. 1 to FIG. 2, in this embodiment, the unipolar connection terminal 1 further include an elastic structure 5, the elastic structure 5 is arranged inside the insertion tube 2 and is configured to have an electrical contact with the mating terminal, the specific structure, the quantity and the material of the elastic structure 5 are not limited herein. Optionally, the elastic structure 5 includes a plurality of elastic pieces 51, and the elastic pieces 51 can be metal elastic pieces 51 which enable insertion between the insertion tube 2 and the mating terminal to be more stable, and it is beneficial to improve the reliability of the unipolar connection terminal 1. Optionally, the structure of the elastic piece 51 further includes a pair of annular end portions 52; two ends of the plurality of elastic pieces 51 are fixedly connected with the annular end portions 52 respectively, which is beneficial for improving stability of the structure of the elastic structure 5; the annular end portions 52 is provided with an inner convex abutting protrusion 521 which increases a contact area between the elastic structure 5 and the mating terminal, thereby facilitates ensuring the conduction effect of the connector device.

In one embodiment, as another specific implementation of the unipolar connection terminal 1 for high-voltage connector provided in this embodiment, a circumferential arc length between the first fool-proof protrusion 31 and the second fool-proof protrusions 32 is greater than a circumferential arc length between the second fool-proof protrusions 32, which is beneficial for avoiding an erroneous assembly and ensuring the conduction effect of the connector device.

In one embodiment, as another specific implementation manner of the unipolar connection terminal 1 for high-voltage connector provided in this embodiment, the plurality of protrusion structures 3 include two second fool-proof protrusions 32; and the distances between the first fool-proof protrusion 31 and the two second fool-proof protrusions 32 are identical, so that the erroneous assembly is avoided, the conduction effect of the connector device is guaranteed, meanwhile, the design and the processing are facilitated, and the production efficiency is improved.

In one embodiment, as another specific implementation manner of the unipolar connection terminal 1 for high-voltage connector provided in this embodiment, the plurality of protrusion structures 3 include two second fool-proof protrusions 32; a circumferential arc length between the two second fool-proof protrusions 32 is greater than a width of the first fool-proof protrusion 31, an erroneous assembly caused when two adjacent second fool-proof protrusions 32 are placed in the first relief groove during assembling, which is due to the fact that the circumferential arc length between two adjacent second fool-proof protrusions 32 is less than a width of the first relief groove, is avoided; the accuracy of assembling is further guaranteed, and the conduction effect of the connector device is further guaranteed.

The invention further provides a connector device which includes a housing with an inner cavity, and the aforesaid unipolar connection terminal 1 arranged in the housing, an inner wall of the housing is recessed to form relief grooves for accommodating the protruding structures 3; according to the connection device, the unipolar connection terminal 1 is arranged in the housing with the inner cavity, the inner wall of the housing is recessed to form the relief grooves for accommodating the protruding structures 3, the unipolar connection terminal 1 has at least three protrusion structures 3 which are formed by extending in the radial direction of the end portion of the insertion tube 2 to be connected and passed through by the mating terminal, and the at least three protrusion structures 3 are arranged at intervals in a circumferential direction of the end surface of the insertion tube 2, when the unipolar connection terminal 1 is mounted in the housing of the connector device, erroneous assembly can be effectively avoided due to the matching between the protrusion structures 3 disposed at the end portion of the insertion tube 2 and the relief grooves recessed on the inner wall of the housing, and the conduction effect of the connector device is guaranteed. Optionally, the protruding structures 3 include a first fool-proof protrusion 31 and second fool-proof protrusions 32. The inner wall of the housing is recessed to form a first rectangular relief groove for accommodating the first fool-proof protrusion 31 and form second rectangular relief grooves for accommodating the second fool-proof protrusions 32. A precise assembling is completed by placing the first fool-proof protrusion 31 into the first relief groove and placing the second fool-proof protrusions 32 into the second relief grooves correspondingly; optionally, a circumferential arc length between two adjacent second fool-proof protrusions 32 is greater than a width of the first relief groove, the erroneous assembly caused when two adjacent second fool-proof protrusions 32 are placed in the first relief groove, which is due to the fact that the circumferential arc length of two adjacent second fool-proof protrusions 32 is less than the width of the first relief groove, is avoided, the accuracy of assembling is further ensured, and the conduction effect of the connector device is further ensured.

Referring to FIG. 1 to FIG. 2, in this embodiment, the connector device is provided with snap-fit protrusions 21 arranged on an outer peripheral wall of the insertion tube 2 of the unipolar connection terminal 1, an inner wall of the housing is provided with snap-fit members matched with the snap-fit protrusions 21, and the unipolar connection terminal 1 snap-fits into the housing of the connector device stably through a snap-fit engagement, the specific structure and the quantity of the snap-fit protrusions 21 of the insertion tube 2 are not limited herein, optionally, there are a plurality of snap-fit protrusions 21, and the plurality of snap-fit protrusions 21 are arranged at intervals on the outer peripheral wall of the insertion tube 2, which is beneficial for improving the stability of the connection between the housing and the unipolar connection terminal 1; optionally, the snap-fit protrusions 21 are snap-fit elastic pieces 51, the resistance forces acted on the in the assembly process are reduced while the stable connection between the housing and the unipolar connection terminal 1 is ensured, the snap-fit elastic pieces 51 are contracted after being squeezed, so that the resistance forces are reduced, and the assembler is facilitated to assemble the connector device.

The foregoing are only preferable embodiments of the embodiments, and should not be regarded as limitations to the embodiments. All modifications, equivalent replacements, and improvements which are made within the spirit and the principle of the embodiments should all be included in the protection scope of the embodiments.

What is claimed is:

1. A unipolar connection terminal for a connector, comprising: a columnar insertion tube configured to be connected and passed through by a mating terminal, an end portion of the insertion tube extends in a radial direction to form at least three protrusion structures, the at least three protrusion structures are arranged at intervals in a circumferential direction of an end surface of the insertion tube, wherein at least one of the protrusion structures is a first fool-proof protrusion, and at least two of the protrusion structures are second fool-proof protrusions, and a cross-sectional area of the first fool-proof protrusion is greater than a cross-sectional area of any one of the second fool-proof protrusions wherein distances between the first fool-proof protrusion and the second fool-proof protrusions are identical.

2. The unipolar connection terminal for a connector according to claim 1, wherein another axial end of the insertion tube away from the protruding structures is provided with a crimping part configured to press the mating terminal tightly; one of the first fool-proof protrusion and the second fool-proof protrusions, and the crimping part are located on the same side circumferentially.

3. The unipolar connection terminal for a connector according to claim 2, wherein the second fool-proof protrusion and the crimping portion are located on the same side circumferentially.

4. The unipolar connection terminal for a connector according to claim 1, wherein a circumferential arc length between the first fool-proof protrusion and the second fool-proof protrusions is greater than a circumferential arc length between the second fool-proof protrusions.

5. The unipolar connection terminal for a connector according to claim 1, wherein a circumferential arc length between the two second fool-proof protrusions is greater than a width of the first fool-proof protrusion.

6. The unipolar connection terminal for a connector according to claim 1, wherein the unipolar connection terminal is a one-piece member integrally molded by punching.

7. The unipolar connection terminal for a connector according to claim 1, further comprising an elastic structure, the elastic structure is configured to be arranged in the insertion tube, and the elastic structure comprises a plurality of elastic pieces configured to be in an electrical contact with the mating terminal.

8. The unipolar connection terminal for a connector according to claim 1, wherein an outer peripheral wall of the insertion tube is provided with snap-fit protrusions.

9. The connector device according to claim 8, wherein there are a plurality of the snap-fit protrusions, and the plurality of the snap-fit protrusions are arranged at intervals on the outer peripheral wall of the insertion tube.

10. The connector device according to claim 8, wherein the snap-fit protrusions are snap-fit elastic pieces.

11. A unipolar connection terminal for a connector, comprising: a columnar insertion tube configured to be connected and passed through by a mating terminal, an end portion of the insertion tube extends in a radial direction to form at least three protrusion structures, the at least three protrusion structures are arranged at intervals in a circumferential direction of an end surface of the insertion tube, an elastic structure is configured to be arranged in the insertion tube, and the elastic structure comprises a plurality of elastic pieces configured to be in an electrical contact with the mating terminal, wherein the elastic piece structure comprises a pair of annular end portions, two ends of each of the plurality of elastic pieces are fixedly connected with the annular end portions respectively; each of the annular end portions is provided with an inner convex abutting protrusion.

* * * * *